United States Patent [19]

Shannon

[11] Patent Number: 4,745,671

[45] Date of Patent: May 24, 1988

[54] BRAKE DRUM REMOVAL DEVICE

[76] Inventor: Arthur W. Shannon, 3700 Darby Rd., Bryn Mawr, Pa. 19010

[21] Appl. No.: 23,645

[22] Filed: Mar. 9, 1987

[51] Int. Cl.[4] ..... B25B 19/00

[52] U.S. Cl. ..... 29/254; 29/275

[58] Field of Search ..... 29/254–255, 29/275–277, 259, 260, 261; 269/130–132

[56] References Cited

U.S. PATENT DOCUMENTS

| | | | |
|---|---|---|---|
| 1,607,957 | 11/1926 | Koehler | 29/261 |
| 1,620,211 | 3/1927 | Jerabek | 29/261 |
| 2,489,413 | 11/1949 | Hink | 29/261 |
| 3,215,464 | 11/1965 | Overman | 29/261 |
| 3,704,503 | 12/1972 | Haywood | 269/131 |
| 3,986,242 | 10/1976 | Kerr | 29/261 |
| 4,307,635 | 12/1981 | Genova | 29/254 |
| 4,463,489 | 8/1984 | James | 29/261 |

*Primary Examiner*—Robert C. Watson

*Attorney, Agent, or Firm*—Ratner & Prestia

[57] ABSTRACT

Article removal apparatus having a plurality of bearing members adapted to engage the rear surface of an article to be removed from its mounting member. The bearing members are attached to or a part of a flexible belt adapted to be tightened on a peripheral surface of the article to be removed with the bearing members engaging the rear surface of the article. A slide hammer is attached to the flexible belt, so that the impact of the slide of the slide hammer is transferred to the bearing members.

14 Claims, 1 Drawing Sheet

BRAKE DRUM REMOVAL DEVICE

TECHNICAL FIELD

The present invention relates, in general, to mechanical tools and, in particular, to apparatus for use by mechanics in removing articles such as brake drums, gears and pulleys from axles and shafts upon which they are mounted.

BACKGROUND ART

Typically, a brake drum or similar article mounted on an axle or shaft is removed by a mechanic tapping the article with a hammer to loosen the article. The tighter the fit of the article on its mounting member, the more force required to remove the article.

Often, such removal will cause damage to the article being removed or to its mounting member or to both, particularly when the fit between the two is very tight. Besides damaging the article at the points where it is hit by the hammer, the bore of the mounting hole in the article or the section of the axle or shaft where the article is mounted can be damaged by impacts of the hammer which are off the axis of the bore and the mounting member.

In recognition of this problem certain removal apparatus has been made available in the past for removal of relatively thin gears and pulleys. Such apparatus includes a slide hammer and a number of rigid hooked members, typically three, connected to the slide hammer with the hook ends of the hooked members adapted to engage one of the planar side surfaces of the gear or pulley. The impact of the slide hammer is transferred through the hooked members to the gear or pulley to loosen the article and move it along its mounting.

While such removal apparatus provides the desirable result of producing an axial force in the removal of the article, it suffers from a number of shortcomings and limitations. Placement of as few as two hooks on the article to be removed and maintaining the hooks in position while the slide hammer is positioned and operated is difficult and can require two mechanics. After one or two of the hooks are positioned on the article, they can fall off easily as the remaining hooks are positioned on the article. In addition, because the hooked members are rigid, there are constraints on the size of the article being removed in that hooked members cannot adapt to the profile of the article.

DISCLOSURE OF THE INVENTION

Article removal apparatus, constructed in accordance with the present invention, includes a flexible belt adapted to extend around a peripheral surface of an article and having a plurality of bearing members adapted to engage a surface of the article transverse to the peripheral surface. Also included are means for tightening the belt on an article, a fastening block, and a plurality of flexible members connected between the fastening block and a plurality of spaced points on a belt. The apparatus of the invention further includes a slide hammer having its slide rod attached to the fastening block.

A particular application of the present invention is the removal of brake drums from their axles. While the invention will be described in connection with the removal of a brake drum, it will be apparent that the invention has broader application for the removal of other articles, such as gears and pulleys, and even can be used to remove non-circular articles.

BEST MODE FOR CARRYING OUT THE INVENTION

Figure 1:
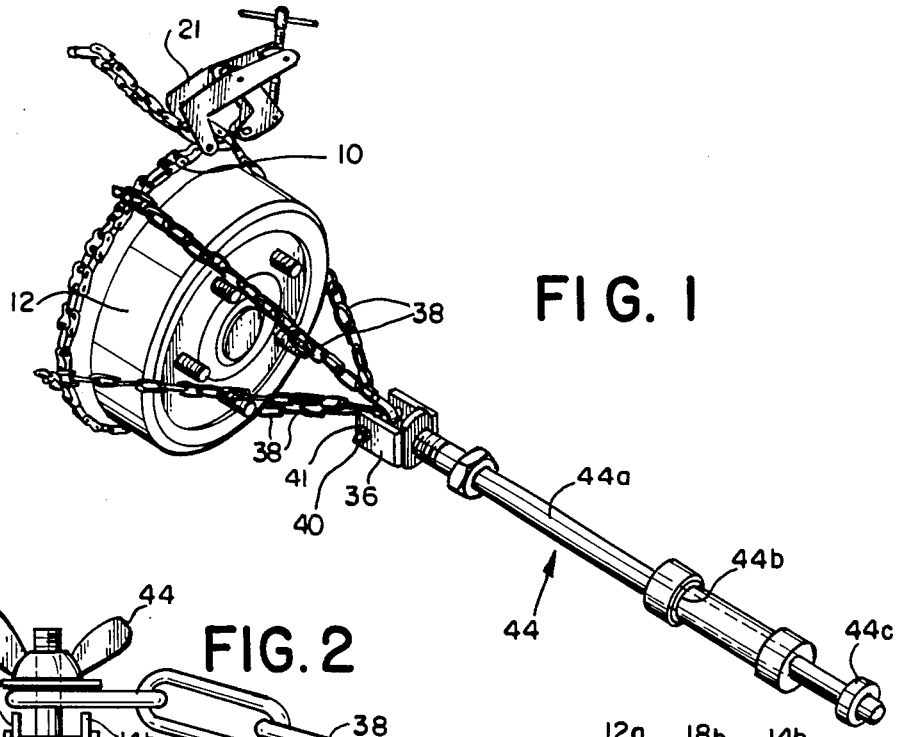
FIG. 1 is a perspective view of a preferred embodiment of article removal apparatus constructed in accordance with the present invention positioned on a brake drum.
Figure 2:
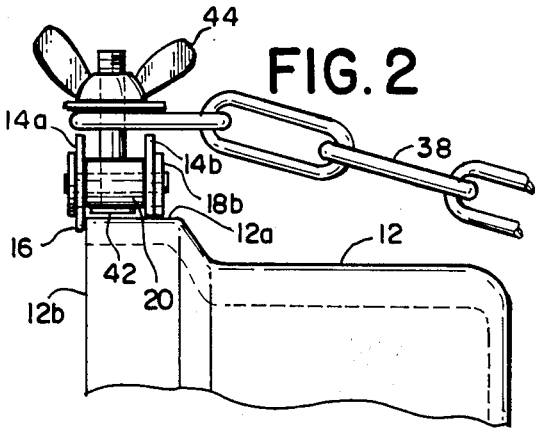
FIG. 2 is a side view of a portion of the FIG. 1 apparatus positioned on a brake drum.

Referring to the drawing, article removal apparatus, constructed in accordance with the present invention, includes a flexible belt, preferably in the form of a sprocket chain 10, adapted to extend around a peripheral surface of an article, such as a brake drum 12, which is to be removed from its mounting member. As shown most clearly in FIG. 2, sprocket chain 10 is positioned on the peripheral surface 12*a* of brake drum 12 at the rear surface 12*b* of the brake drum which is transverse to peripheral surface 12*a*.

Figure 3:
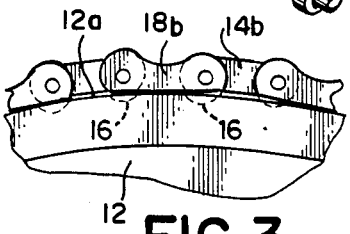
FIG. 3 is a front view of a portion of the FIG. 1 apparatus positioned on a brake drum.

Sprocket chain 10 has a plurality of bearing members adapted to engage rear surface 12*b* of brake drum 12. One roller line plate 14*a* of each pair of roller link plates 14*a*, 14*b* of sprocket chain 10 extends in a direction transverse to the length of the sprocket chain beyond the remainder of the sprocket chain to form a lip 16 adapted to bear against rear surface 12*b* of brake drum 12 while the sprocket chain extends around the periphery of the brake drum. This is shown most clearly in FIGS. 2 and 3.

Sprocket chain 10 may be assembled in the usual way and then roller link plate 14*b* and pin link plate 18*b* can be ground or filed down, so that they extend slightly beyond bushings 20 of the sprocket chain. Alternatively, roller link plate 14*b* and pin link plate 18*b* can be stamped and then included in the assembly of the sprocket chain.

Figure 4:
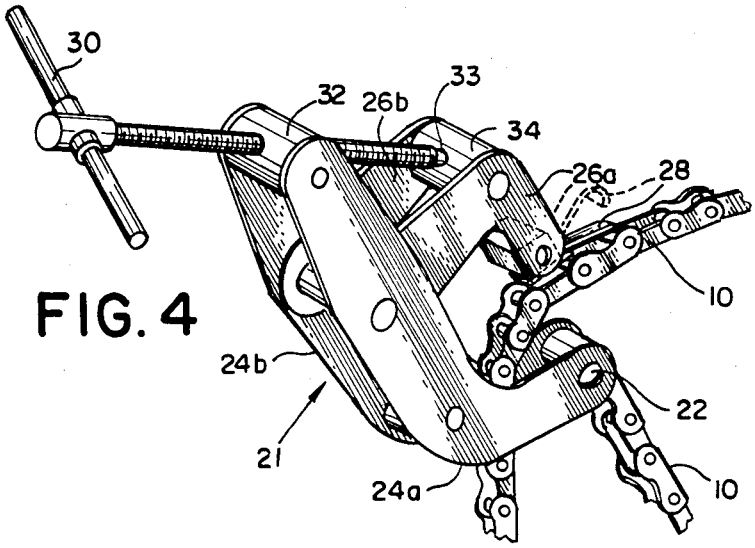
FIG. 4 is a perspective view of a tightening mechanism which can be used in the present invention.

Sprocket chain 10 can be tightened on brake drum 12 by any suitable mechanism. FIG. 4 shows the details of a clamping mechanism 21 which has been found to be particularly useful. One end of sprocket chain 10 is attached to clamping mechanism 21 by means of a screw 22 extending through the sprocket chain and a pair of plates 24*a* and 24*b* between which the sprocket chain is positioned. The free end of sprocket chain 10 passes loosely between plates 24*a* and 24*b*.

A second pair of plates 26*a* and 26*b*, pivotally mounted between plates 24*a* and 24*b*, carries a hook 28 which engages one of the bushings 20 of sprocket chain 10. The position of hook 28 is shown in dashed lines in FIG. 4 prior to engagement with a bushing 20 and in solid lines when positioned to engage a bushing. The free end of sprocket chain 10 is drawn between plates 24*a* and 24*b* as a threaded T-handle 30 is turned. The shank of T-handle 30 passes through a threaded member 32 pivotally mounted between plates 24*a* and 24*b* and extends into a bore 33 in a member 34 which is pivotally mounted between plates 26*a* and 26*b*. The end of T-handle 30 turns freely in bore 33 of member 34 but is held captive in bore 33 against removal. As T-handle 30 is turned, plates 26*a* and 26*b* pivot relative to plates 24*a* and 24*b* to draw hook 28 toward plates 24*a* and 24*b*. This takes up the slack in sprocket chain 10 and tightens the sprocket chain on brake drum 12. The tightening of sprocket chain 10 is done with lips 16 bearing against rear surface 12*b* of brake drum 12.

The removal apparatus of the invention further includes a fastening block 36 which is connected to sprocket chain 10 by means of plurality of flexible members, in the form of chains 38. These chains have one end attached to fastening block 36 by means of a bolt 40, which passes through the end links of chains 38, and a nut 41. The other ends of chains 38 are attached to sprocket chain 10 at equally spaced points along the length of the sprocket chain by means of bolts 42 which extend through the sprocket chain and the end links of chains 38. Chains 38 are held captive to bolts 42 by means of nuts 44. Roller link plates 14*b* and pin link plates 18*b* are sized to accommodate the heads of bolts 42 between bushings 20 and peripheral surface 12*a* of brake drum 12.

Also included in the removal apparatus is a slide hammer 44 which is attached to fastening block 36 by means of a threaded end of the slide rod 44*a* of the slide hammer received in a threaded bore in the fastening block. Slide hammer 44 also has a slide 44*b* which is movable along slide rod 44*a* and abuts against a stop 44*c* when propelled along slide rod 44*a*.

In use, after sprocket chain has been tightened on brake drum 12 as previously described, slide rod 44*a* is screwed into fastening block 36. Next, slide hammer 44 is raised into position, so that the slide hammer is aligned substantially along the axis of brake drum 12 with no slack in chains 38. Then slide 44*b* is propelled along slide rod 44*a* toward stop 44*c*. The impact of slide 44*b* abutting against stop 44*c* is transferred through slide rod 44*a*, fastening block 36, and chains 38 to lips 16 of sprocket chain 10 to loosen brake drum 12 from its axle, so that the brake drum can be removed from its axle.

In comparison to apparatus offered previously and referred to above, the present invention makes it easy to position lips 16 of sprocket chain 10 against the rear surface of the article to be removed, namely surface 12*b* of brake drum 12. This results from lips 16 being connected to or part of a common flexible belt, namely sprocket chain 10. Also chains 38, being flexible, permit adaptation to the profile of the article being removed, so that an article, such as a brake drum, having a relatively large diameter and a relatively large thickness can be removed from its mounting member. In addition, the impact of the slide hammer can be distributed over a relatively large number of contact points because the bearing members are connected to or part of the common flexible belt. For the embodiment of the invention described and illustrated, lips 16 bear against rear surface 12*b* of brake drum 12 almost continuously over 360°.

The foregoing has set forth an exemplary and preferred embodiment of the present invention. It will be understood, however, that various alternatives will occur to those of ordinary skill in the art without departure from the spirit and scope of the present invention.

I claim:

1. Article removal apparatus comprising:

a flexible belt adapted to extend around a peripheral surface of an article and having a plurality of bearing members adapted to engage a surface of said article transverse to said peripheral surface;

means for tightening said belt on an article;

a fastening block;

a plurality of flexible members connected between said fastening block and plurality of spaced points on said belt;

and a slide hammer having its slide rod attached to said fastening block.

2. Article removal apparatus according to claim 1 wherein each of said plurality of flexible members is a chain.

3. Article removal apparatus according to claim 2 wherein said spaced points are equally spaced.

4. Article removal apparatus according to claim 3 wherein said fastening block has a threaded bore and said slide rod has a threaded end fitted into said threaded bore.

5. Article removal apparatus according to claim 1 wherein said flexible belt is a sprocket chain.

6. Brake drum removal apparatus comprising:

a sprocket chain adapted to extend around the periphery of a brake drum at the rear surface of said brake drum, one roller link of each pair of roller links of said sprocket chain extending in a direction transverse to the length of said sprocket chain beyond the remainder of said sprocket chain to form a lip adapted to engage the rear surface of said drum;

means for tightening said sprocket chain on a brake drum;

a fastening block;

a plurality of flexible members connected between said fastening block and a plurality of spaced points on said sprocket chain;

and a slide hammer having its slide rod attached to said fastening block.

7. Brake drum removal apparatus according to claim 6 wherein each of said plurality of flexible members is a chain.

8. Brake drum removal apparatus according to claim 7 wherein said spaced points are equally spaced.

9. Brake drum removal apparatus according to claim 8 wherein said fastening block has a threaded bore and said slide rod has a threaded end fitted into said threaded bore.

10. Article removal apparatus comprising:

a sprocket chain adapted to extend around a peripheral surface of an article at a surface of said article transverse to said peripheral surface, one roller link of each pair of roller links of said sprocket chain extending in a direction transverse to the length of said sprocket chain beyond the remainder of said sprocket chain to form a lip adapted to engage said surface of said article transverse to said peripheral surface of said article;

means for tightening said sprocket chain on an article;

a fastening block;

a plurality of flexible members connected between said fastening block and a plurality of spaced points on said sprocket chain;

and a slide hammer having its slide rod attached to said fastening block.

11. Article removal apparatus comprising:

a sprocket chain adapted to extend around a peripheral surface of an article at a surface of said article transverse to said peripheral surface, one roller link of each pair of roller links of said sprocket chain extending in a direction transverse to the length of said sprocket chain beyond the remainder of said sprocket chain to form a lip adapted to engage said surface of said article transverse to said peripheral surface of said article;

means for tightening said sprocket chain on an article;

a slide hammer;

a plurality of flexible members each connected at one end individually to a point on said sprocket chain;

and means for connecting a second end of each of said flexible members to the slide rod of said slide hammer.

12. Article removal apparatus according to claim 11 wherein the points on said sprocket chain to which said plurality of flexible members are connected are equally spaced on said sprocket chain.

13. Article removal apparatus according to claim 11 wherein each of said plurality of flexible members is a chain.

14. Article removal apparatus according to claim 13 wherein the points on said sprocket chain to which said chains are connected are equally spaced on said sprocket chain.

* * * * *